US009804529B2

(12) United States Patent
Mugita et al.

(10) Patent No.: US 9,804,529 B2
(45) Date of Patent: Oct. 31, 2017

(54) DEVELOPING DEVICE HAVING DEVELOPER REGULATING RIB

(71) Applicant: CANON KABUSHIKI KAISHA, Tokyo (JP)

(72) Inventors: Naoki Mugita, Toride (JP); Toshihisa Yago, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/001,433

(22) Filed: Jan. 20, 2016

(65) Prior Publication Data

US 2016/0209777 A1 Jul. 21, 2016

(30) Foreign Application Priority Data

Jan. 20, 2015 (JP) ..... 2015-008972

(51) Int. Cl.
*G03G 15/08* (2006.01)

(52) U.S. Cl.
CPC ..... *G03G 15/0891* (2013.01); *G03G 15/0893* (2013.01); *G03G 2215/083* (2013.01);
(Continued)

(58) Field of Classification Search
CPC ..... G03G 15/0887; G03G 15/0891; G03G 15/0893; G03G 15/0889;
(Continued)

(56) References Cited

U.S. PATENT DOCUMENTS 7,493,069 B2 * 2/2009 Akedo ..... G03G 15/0893 399/254
8,295,741 B2 10/2012 Kido
(Continued)

FOREIGN PATENT DOCUMENTS

JP 2006058373 A * 3/2006
JP 2006084976 A * 3/2006
(Continued)

OTHER PUBLICATIONS

Katsuya Nose et al., U.S. Appl. No. 15/002,910, filed Jan. 21, 2016, Art Unit 2852.
Toshihisa Yago et al., U.S. Appl. No. 14/789,424, filed Jul. 1, 2015, Art Unit 2852.

*Primary Examiner* — Robert Beatty
(74) *Attorney, Agent, or Firm* — Fitzpatrick, Cella, Harper & Scinto

(57) ABSTRACT

A developing device includes a developer carrying member for carrying and feeding a developer, first and second chambers for circulating the developer, and a partition wall. A first feeding member feeds the developer in the first chamber in a first feeding direction, and a second feeding member feeds the developer in the second chamber. The second feeding member includes a shaft, a first helical portion for feeding the developer in a second feeding direction, and a second helical portion for feeding the developer in the first feeding direction. The second helical portion is provided on the shaft and provided downstream of the first helical portion via a region where no helical portion is provided. A rib is provided on a first inner surface of the second chamber, with the rib disposed opposite the region where no helical portion is provided and extending upwardly in a vertical direction.

6 Claims, 8 Drawing Sheets

(52) U.S. Cl.
CPC ..... *G03G 2215/0822* (2013.01); *G03G 2215/0838* (2013.01)

(58) Field of Classification Search
CPC ... G03G 2215/0819; G03G 2215/0822; G03G 2215/083; G03G 2215/0838
USPC ..... 399/254, 256, 281
See application file for complete search history.

(56) References Cited

U.S. PATENT DOCUMENTS

| | | | | |
|---|---|---|---|---|
| 8,750,764 | B2 * | 6/2014 | Okuno | G03G 15/0189 399/254 |
| 8,942,600 | B2 * | 1/2015 | Nakaue | G03G 15/0877 399/254 |
| 9,141,032 | B1 * | 9/2015 | Murata | G03G 15/0822 |
| 9,217,957 | B2 * | 12/2015 | Ishida | G03G 15/0921 |
| 2015/0139696 | A1 * | 5/2015 | Ishida | G03G 15/0893 399/254 |

FOREIGN PATENT DOCUMENTS

| | | | |
|---|---|---|---|
| JP | 2009-048139 | A | 3/2009 |
| JP | 2010-113289 | A | 5/2010 |
| JP | 2010-186099 | A | 8/2010 |
| JP | 2010-224105 | A | 10/2010 |
| JP | 2010-237329 | A | 10/2010 |

* cited by examiner (a)

(b)

(a)

(b)

DEVELOPING DEVICE HAVING DEVELOPER REGULATING RIB

FIELD OF THE INVENTION AND RELATED ART

The present invention relates to a developing device for developing an electrostatic latent image on an image bearing member into a toner image with a developer containing a toner and a carrier, and particularly relates to the developing device for feeding the developer toward a discharge opening to discharge the developer to an outside of a developing container through the discharge opening.

In a developing device used in an image forming apparatus such as a copying machine, a printer, a facsimile machine or a multi-function machine, a two-component developer containing a toner and a carrier has been used. The two-component developer lowers in toner charge amount with repetitive use for a long term, and the developer lowered in toner charge amount causes an image defect such as scattering fog. Therefore, in order to suppress the lowering in toner charge amount of the developer, a fresh developer containing the toner in substantially the same amount as an amount of the toner consumed during image formation is supplied into a developing container and on the other hand, excessive developer is discharged to an outside of the developing container.

Conventionally, a developing device in which the developer is fed and discharged through the discharge opening by a stirring and feeding screw including a normal direction feeding screw, a returning screw and a discharging screw which are provided in a remote order from the discharge opening has been known (Japanese Laid-Open Patent Application (JP-A) 2010-186099). In a stirring chamber of this developing device, a "regulating plate" for regulating a surface height of the developer moving toward the discharge opening is provided over a full width of the screws with respect to a radial direction in cross section so as to cover a portion above the normal direction feeding screw or the returning screw.

A developing device in which a "shielding portion" for suppressing flowing of a developer, reversely flowing from a first chamber which is a circulation feeding destination of the developer to a second chamber through an opening, into a discharge opening is provided in a side wall of the second chamber (i.e., a partition wall for partitioning the first and second chambers) has been proposed (JP-A 2010-237329).

In the above-described developing device, of the developer fed toward the discharge opening by the normal direction feeding screw, only the developer reaching the discharge opening against pushing-back by the returning screw is discharged to the outside of the developing container. However, the developer was continuously discharged little by little although a developer amount is small, and as a result, the developer amount was excessively small and thus caused the image defect in some cases. That is, when a flowability of the developer lowers, the developer fed by the normal direction feeding screw is localized on a side-wall side of a stirring chamber (second chamber) in front of and is capable of forming a mountain of the developer having a high developer surface. This mountain of developer is liable to get over the returning screw, and therefore when the mountain of the developer is formed, the developer is continuously discharged gradually although an amount thereof is small.

It would be considered that in the developing device disclosed in JP-A 2010-186099, the "regulating plate" is capable of collapsing the mountain of developer so as to scrape off a crest portion of the mountain. However, in the case where the "regulating plate" is provided along an outer peripheral surface of the returning screw, the developer scraped off by the "regulating plate" falls on the screw and is capable of being discharged. On the other hand, in the case where the "regulating plate" is provided along an outer peripheral surface of the normal direction feeding screw, the developer scraped off is liable to form a mountain again until the developer reaches the returning screw. Further, the "regulating plate" is provided above the screw over a full width of the screw with respect to a radial direction, and therefore it is difficult to adjust a discharge amount of the developer in the case where a developer amount is large, so that an overflow of the developer or the like is liable to generate.

In the developing device disclosed in JP-A 2010-237329, the "shielding portion" is provided only on a side (partition wall side), of side walls of the second chamber, close to the first chamber so as to block the flow of the developer at a position higher than a center height of the returning screw. However, a region where the developer surface height of the developer becomes high actually is a region on a remote side (opposite from the partition wall) from the first chamber in which a screw blade raises for lifting the developer. For that reason, it is difficult to regulate the developer getting over the returning screw through the region, opposite from the first chamber, of the side walls of the second chamber.

SUMMARY OF THE INVENTION

The present invention has been accomplished in view of the above-described circumstances. A principal object of the present invention is to provide a developing device capable of suppressing a lowering in developer amount due to continuous discharge of a developer little by little.

According to an aspect of the present invention, there is provided a developing device comprising: a developer carrying member for carrying and feeding a developer; a first chamber for supplying the developer to the developer carrying member; a second chamber for forming a circulation path of the developer in cooperation with the first chamber; a partition wall for partitioning the first chamber and the second chamber; a first opening, provided downstream of the first chamber with respect to a developer feeding direction of the first chamber, for delivering the developer from the first chamber to the second chamber; a second opening, provided downstream of the second chamber with respect to the developer feeding direction of the second chamber, for delivering the developer from the second chamber to the first chamber; a first feeding member, provided rotatably in the first chamber, for feeding the developer in the first chamber; a second feeding member, provided rotatably in the second chamber, for feeding the developer in the second chamber, wherein the second feeding chamber comprises, a first spiral portion, formed spirally, for feeding the developer in the developer feeding direction of the second chamber, a second spiral portion provided downstream of the first spiral portion with respect to the developer feeding direction of the first spiral portion and formed spirally in an opposite direction to a direction of helicity of the first spiral portion, and a connecting portion for connecting the first spiral portion and the second spiral portion; and a discharge opening, provided upstream of the second spiral portion with respect to the developer feeding direction of the second spiral portion, for permitting discharge of the developer, wherein the second opening is provided at an overlapping position with both of the first spiral portion and the second spiral portion with respect to a rotational axis direction of the second feeding member, and wherein an inner wall of the second chamber opposing the connecting portion is provided with a projected portion projected toward the connecting portion and extended in a vertical direction, the projected portion having a lower end formed at a position lower than an upper end of the second spiral portion.

DESCRIPTION OF THE EMBODIMENTS

Figure 1:
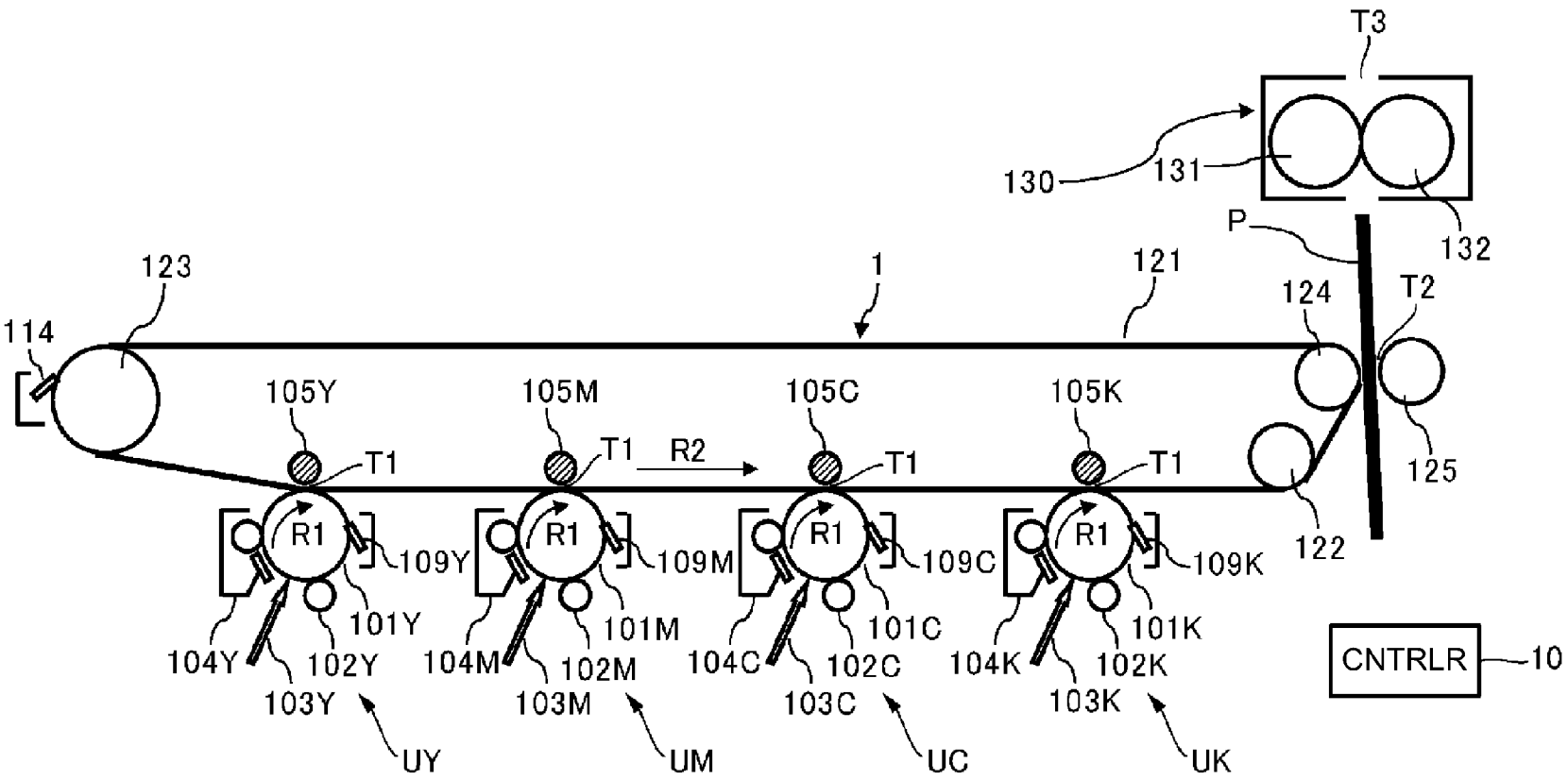
FIG. 1 is a schematic illustration of a structure of an image forming apparatus including a developing device according to the present invention.

A developing device according to an embodiment of the present invention will be described. First, a general structure of an image forming apparatus including the developing device according to the present invention will be described with reference to FIG. 1. An image forming apparatus 1 shown in FIG. 1 is an intermediary transfer type full color printer of a tandem type in which image forming portions UY, UM, UC and UK are arranged along an intermediary transfer belt 121.

<Image Forming Apparatus>

At the image forming portion UY, a yellow toner image is formed on a photosensitive drum 101Y and then is transferred onto the intermediary transfer belt 121. At the image forming portion UM, a magenta toner image is formed on a photosensitive drum 101M and then is transferred onto the intermediary transfer belt 121. At the image forming portion UC and UK, cyan and black toner images are formed on photosensitive drums 101C and 101K respectively, and then are transferred onto the intermediary transfer belt 121. The four color toner images transferred on the intermediary transfer belt 121 are fed to a secondary transfer portion T2 and are secondary-transferred collectively onto a recording material P (sheet material such as a sheet or an OHP sheet).

The image forming portions UY, UM, UC and UK have the substantially same construction except that colors of toners used in developing devices 104Y, 104M, 104C and 104K, respectively, are yellow, magenta, cyan and black, respectively. The yellow image forming portion UY is described as a representative, and other image forming portions UM, UC and UK will be described by reading a suffix Y of symbols as M, C and K.

The image forming portion U includes, at a periphery of the photosensitive drum 101 as an image bearing member, a primary charging device 102, an exposure device 103, the developing device 104, a transfer charging device 105 and a drum cleaning device 109. The photosensitive drum 101 is prepared by forming a photosensitive layer on an outer peripheral surface of an aluminum cylinder, and is rotated in an arrow R1 direction at a predetermined process speed.

The primary charging device 102 is, e.g., a roller-shaped charging roller and electrically charges the photosensitive drum 101 to a uniform negative dark portion potential in contact with the photosensitive drum 101 under application of a charging bias voltage. The exposure device 103 generates a laser beam, from a laser beam emitting element, obtained by subjecting scanning line image data which is developed from an associated color component image to ON-OFF modulation and then to scanning through a rotating mirror, so that an electrostatic image for an image is formed on the surface of the charged photosensitive drum 101. The developing device 104 supplies the toner to the photosensitive drum 101 and develops the electrostatic image into the toner image.

The transfer charging device 105 is disposed opposed to the photosensitive drum 101 via the intermediary transfer belt 121 and forms a toner image primary transfer portion T1 between the photosensitive drum 101 and the intermediary transfer belt 121. By applying a transfer bias to the transfer charging device 105 at the primary transfer portion T1, the toner image is primary-transferred from the photosensitive drum 101 onto the intermediary transfer belt 121. The drum cleaning device 109 rubs the photosensitive drum 101 with a cleaning blade and collects a primary transfer residual toner slightly remaining on the photosensitive drum 101 after the primary transfer.

The intermediary transfer belt 121 is extended around and supported by a driving roller 122, a tension roller 123, an inner secondary transfer roller 124 and the like, and is driven by the driving roller 122, so that the intermediary transfer belt 121 is rotated in an arrow R2 direction in FIG. 1. A secondary transfer portion T2 is a toner image transfer nip onto a recording material P formed by contact of an outer secondary transfer roller 125 with the intermediary transfer belt 121 stretched by the inner secondary transfer roller 124. At the secondary transfer portion T2, by applying a secondary transfer bias to the outer secondary transfer roller 125, the toner image is secondary-transferred from the intermediary transfer belt 121 onto the recording material P fed to the secondary transfer portion T2. A secondary transfer residual toner remaining on the intermediary transfer belt 121 while being deposited on the intermediary transfer belt 121 is collected by rubbing the intermediary transfer belt 121 with a belt cleaning device 114.

The recording material P on which the four color images are secondary-transferred at the secondary transfer portion T2 is fed to a fixing device 130. The fixing device 130 forms a fixing nip T3 by contact between fixing rollers 122*a* and 122*b*, and at the fixing nip T3, the toner image is fixed on the recording material P while feeding the recording material P. In the fixing device 130, the fixing nip T3 is formed by causing the fixing roller 122*b* to be press-contacted by an urging mechanism (not shown) to the fixing roller 122*a* heated from an inside by a lamp heater (not shown). By nipping and feeding the recording material P at the fixing nip T3, the toner image is heated and pressed, so that the toner image is fixed on the recording material P. The recording material P on which the toner image is fixed by the fixing device 130 is discharged to an outside of the image forming apparatus 1.

<Controller>

Figure 2:
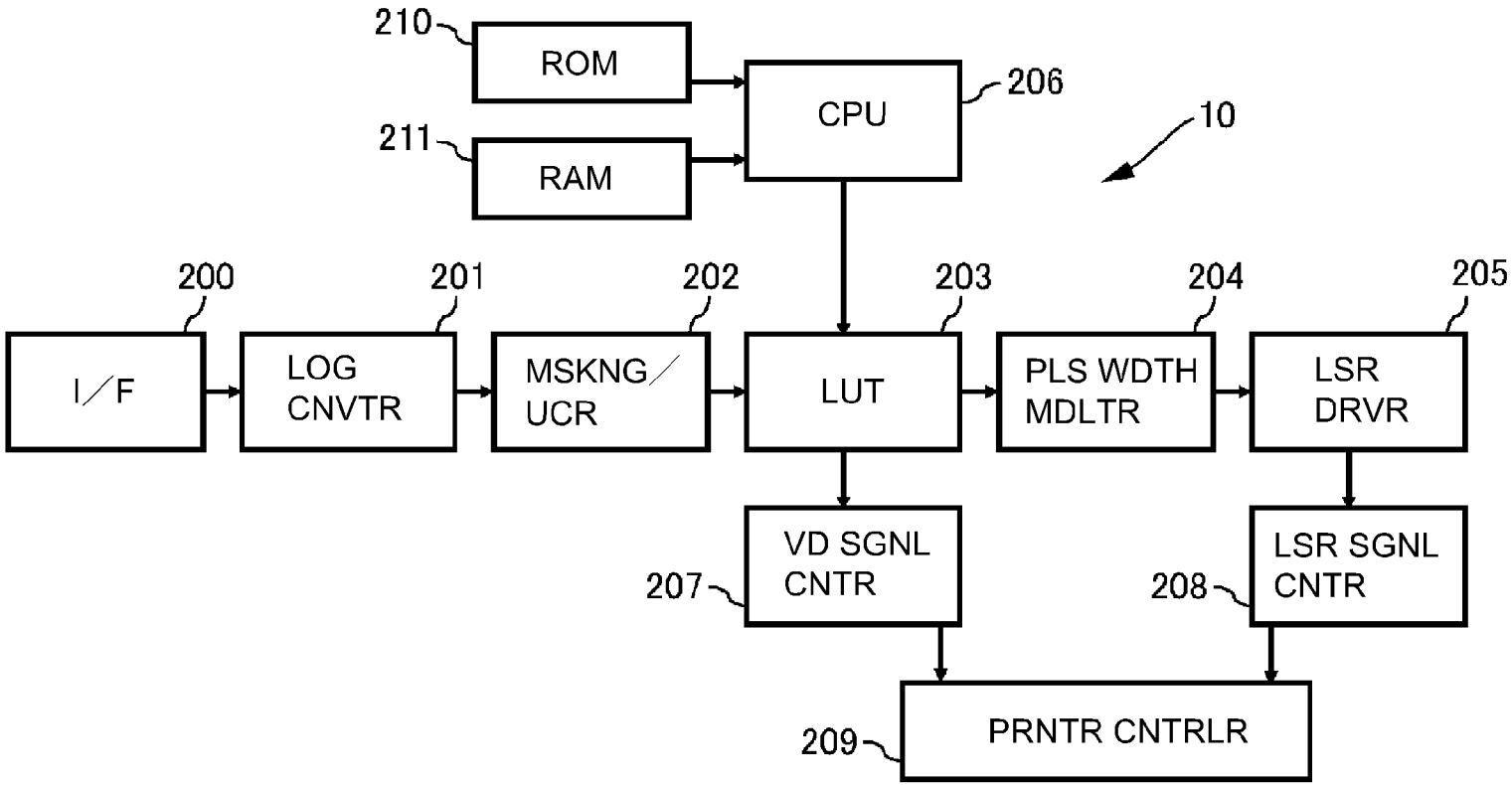
FIG. 2 is a block diagram showing a system constitution of a controller.

The image forming apparatus 1 includes a controller 10. The controller 10 will be described using FIG. 2. A system constitution of the controller 10 is shown in FIG. 2. As shown in FIG. 2, the controller 10 includes a CPU 206. The CPU 206 executes various software programs such as an image control program stored in a ROM 210, and controls respective blocks described below with execution of the programs. A RAM 211 temporarily stores control data and the like, and is used as an operation region of computation with the execution of the programs.

Through an external input interface (I/F) 200, color image data as RGB image data are inputted from an unshown external device such as an original scanner or a computer (information processing device) as desired which are connected with the external input interface 200 so that data communication is enabled. A LOG conversion portion 201 converts luminance data of the RGB form image data inputted through the external input interface 200 into CMYK form density data (CMYK image data) on the basis of a look-up table (LUT) constituted (prepared) by data or the like stored in an ROM 210. A masking/UCR portion 202 extracts a black (K) component data from the converted CMYK image data and subjects CMRK image data to matrix operation in order to correct color shading of a recording colorant. A look-up table portion (LUT portion) 203 causes the CMYK image data to coincide with an ideal gradation characteristic of a printer portion controller 209, and specifically makes density correction of the CMYK image data, inputted from the masking/UCR portion 202, for each of the colors by using a gamma (γ) look-up table. Incidentally, the γ look-up table is prepared on the basis of the data developed on an ROM 211 and the contents of the table are set by a CPU 206. A pulse width modulation portion 204 outputs a pulse signal with a pulse width corresponding to the CMYK image data (image signal) inputted from the LUT portion 203. On the basis of this pulse signal, a laser driver 205 drives the laser emitting element of the exposure device 103 to irradiate the surface of the photosensitive drum 101 with laser light, so that the electrostatic image is formed on the surface of the photosensitive drum 101.

A video signal count portion 207 is a circuit for adding up a level for each pixel (0 to 255 level) for a screenful of the image with respect to 600 dpi of the CMYK image data inputted into the LUT portion 203. The integrated value of the image data is referred to as a video count value. A maximum of this video count value is 1023 in the case where all the pixels for the output image are at the 255 level. Incidentally, when there is a restriction on the constitution of the circuit, by using a laser signal count portion 208 in place of the video signal count portion 207, the image signal from the laser driver 205 is similarly calculated, so that it is possible to obtain the video count value. A signal for the video count value is inputted into the printer controller 209. On the basis of the signal, the printer controller 209 effects various pieces of control such as control of rotational speeds of a developing sleeve 24 and developing screws 22*a* and 22*b* described later.

<Developing Device>

Figure 3:
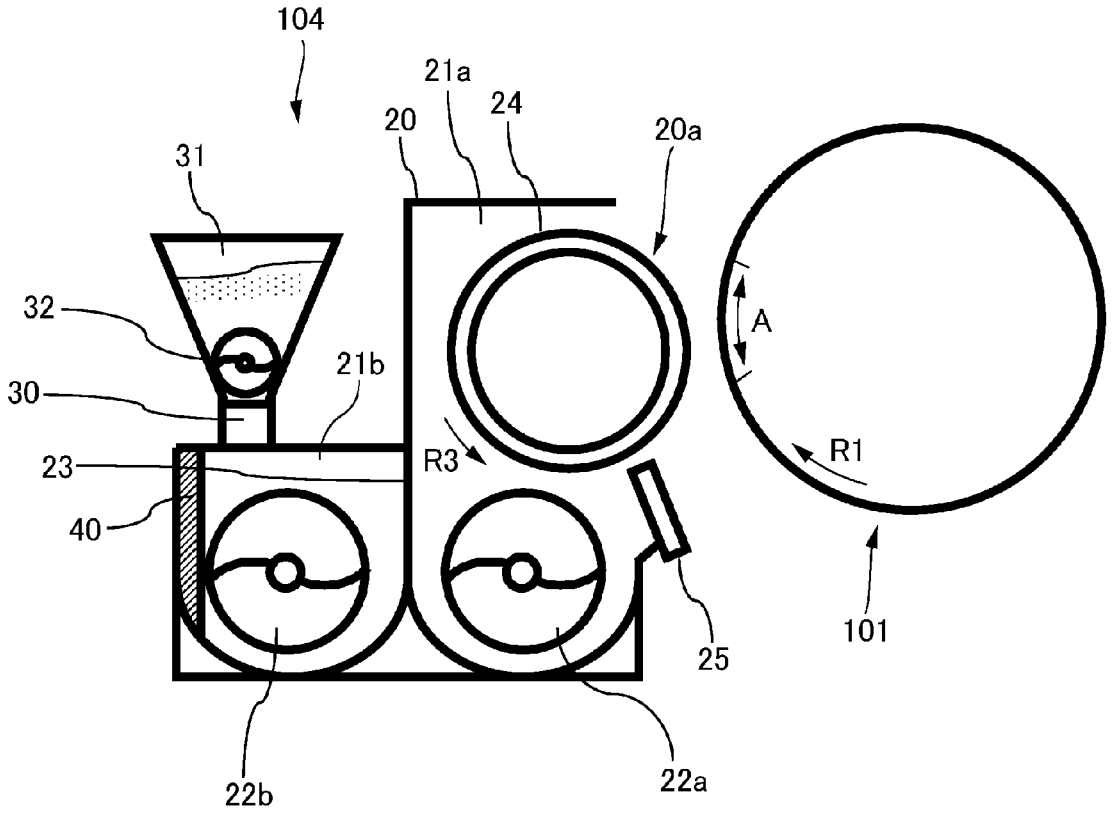
FIG. 3 is a sectional view showing a structure of the developing device in cross section perpendicular to a shaft (axis).

The developing device 104 will be described using FIGS. 3 and 4. For easy understanding, in FIG. 4, the developing sleeve 24 and a regulating blade 25 are omitted from illustration. The developing device 104 shown in FIG. 3 is of a horizontal stirring type in which a developing chamber 21*a* and a stirring chamber 21*b* are horizontally provided. The developing device 104 includes a developing container 20 forming a housing, and in the developing container 20, a developing screw 22*a*, a stirring screw 22*b*, the developing sleeve 24, the regulating blade 25, and the like are provided.

As shown in FIG. 3, the developing sleeve 24 as a developer carrying member is partly exposed through an opening 20*a* of the developing container 20 provided at a position opposing the photosensitive drum 101 and is provided rotatably in the developing container 20. The developing sleeve 24 rotates in an arrow R3 direction in FIG. 3 while carrying the developer having a layer thickness regulated by the regulating blade 25, and feeds the developer to the opposing photosensitive drum 101. The regulating blade 25 is a plate-like member formed of a non-magnetic material such as aluminum, and is disposed upstream of the photosensitive drum 101 with respect to a rotational direction of the developing sleeve 24 along a longitudinal direction of the developing sleeve 24. The regulating blade 25 is disposed opposed to the developing sleeve 24 so that a free end thereof is directed toward a rotation center of the developing sleeve 24. By adjusting a spacing (gap) between the free end of the regulating blade 25 and the surface of the developing sleeve 24, a coating amount of the developer fed to a developing region A is adjusted. In this way, the toner is supplied to the electrostatic image formed on the photosensitive drum 101, so that the electrostatic image is developed into the toner image.

An inside of the developing container 20 for accommodating the two-component developer containing the toner and the carrier is partitioned, as shown in FIG. 3, with respect to a horizontal direction into a right-side developing chamber 21*a* and a left-side stirring chamber 21*b* by a partition wall 23 extending in a vertical direction at a substantially central portion. As shown in FIG. 4, the developing chamber 21*a* and the stirring chamber 21*b* communicate with each other through communicating portions 26 and 27 as openings provided at both end portions of the partition wall 23 as a first wall portion, and form a circulation path of the developer.

In chambers consisting of the developing chamber 21*a* as a first chamber and the stirring chamber 21*b* as a second chamber, the developing screw 22*a* as a first feeding means and the stirring screw 22*b* as a second feeding means are rotatably provided. Each of the developing screw 22*a* and the stirring screw 22*b* has a screw structure including a feeding blade (screw blade) provided spirally around a rotation shaft. Therefore, by rotation of the developing screw 22*a* and the stirring screw 22*b*, the developer is circulated and fed in the developing container 20 while being stirred. With the feeding of the developer while stirring the developer, the toner is negatively charged and the carrier is positively charged.

The developing screw 22*a* is disposed substantially in parallel with the developing sleeve 24 (FIG. 3) along the rotation shaft of the developing sleeve 24 in the developing chamber 21*a*, and the stirring screw 22*b* is disposed substantially in parallel with the developing screw 22*a* in the stirring chamber 21*b*. When the developing screw 22*a* rotates, the developer in the developing chamber 21*a* is fed in a predetermined direction along the rotation shaft of the developing screw 22*a*, i.e., in one direction from right to left in the case of FIG. 4. The developer fed toward a downstream side of the developing chamber 21*a* with respect to a developer feeding direction is delivered to the stirring chamber 21*b* through the communicating portion 27. On the other hand, when the stirring screw 22*b* rotates, the developer in the stirring chamber 21*b* is fed in one direction from left to right in FIG. 3 along the rotation shaft of the stirring screw 22*b*, i.e., an opposite direction to the developer feeding direction in the developing chamber 21*a*. The developer fed toward a screw side of the stirring chamber 21*b* with respect to the developer feeding direction is delivered to the developing chamber 21*a* through the communicating portion 26. That is, the developer fed by rotation of the developing screw 22*a* and the stirring screw 22*b* is circulated and fed between the developing chamber 21*a* and the stirring chamber 21*b* through the communicating portions 26 and 27 provided at the both end portions of the partition wall 23. However, as described later specifically, in the case where the developer amount in the developing container 20 is large, a part of the developer fed by the stirring screw 22*b* is not delivered to the developing chamber 21*a* through the communicating portion 26 but is fed toward a side downstream of the communicating portion 26 with respect to the developer feeding direction. In this way, the developer which is subjected to development on the developing sleeve 24 and which is lowered in toner charge amount is sufficiently mixed in the stirring screw 21*b*, so that the toner charge amount is restored and then the developer is returned to the developing chamber 21*a*.

<Supply of Developer>

Supply of the developer will be described. As shown in FIGS. 3 and 4, at an upper portion of the stirring chamber 21*b* in an upstream side of the stirring chamber 21*b* with respect to the developer feeding direction, a supply opening 30 is provided, and through this supply opening 30, a developer supplying device 31 is connected with the stirring chamber 21*b*. A supplying developer containing the toner and the carrier is supplied from the developer supplying device 31 (e.g., a hopper) as a supplying portion. The supplying developer is stirred together with the developer in the developing container 20, whereby a toner content (concentration) of the developer carried on the developing sleeve 24 can be maintained at a constant level.

The developer supplying device 31 includes a supplying screw 32 having a screw structure. The supplying developer is supplied to the stirring chamber 21*b* through the supplying opening 30 by a rotational force of the supplying screw 32 and gravitation and is fed toward a downstream side with respect to the developer feeding direction by the stirring screw 22*b*. An amount of the supplying developer supplied from the developer supplying device 31 to the stirring chamber 21*b* is roughly determined by a number of rotations of the supplying screw 32. This number of rotations is determined by a toner supply amount control means (not shown) on the basis of a video count value obtained by a video signal counting portion 207 (FIG. 2) or a detection signal of a toner content sensor 304 provided in the developing container 20. The toner supply amount control means adjusts the number of rotations in accordance with a ratio between the toner and the carrier calculated on the basis of the detection signal of the toner content sensor 304 so that the developer in an amount in which the toner content is about 10% in a weight ratio is supplied. In this way, the toner in an amount substantially corresponding to an amount of the toner consumed during the image formation is supplied. As the supplying developer, a developer having a carrier mixing ratio of more than 0% to about 20% is used in general, but a developer having a mixing ratio, between the toner and the carrier, of 9:1 for example, i.e., having the carrier mixing ratio of 10% may preferably be used.

<Discharge of Developer>

In the developing device 104, the supplying developer is supplied as described above, but when the amount of the developer in the developing container 20 becomes excessive, stirring of the developer becomes insufficient, so that density non-uniformity and fog generate or the developer overflows the developing container 20 in some cases. Therefore, in order to prevent an excessive amount of the developer in the developing container 20, the excessive developer is discharged from the developing container 20. This will be described using FIG. 5.

The stirring screw 22*b* for feeding the developer in the stirring chamber 21*b* includes a first spiral portion 301, a second spiral portion 302 and a third spiral portion 303 which are connected from an upstream side of the first spiral portion 301 toward a downstream side of the third spiral portion 303 with respect to a first feeding direction in the listed order. The first spiral portion 301 is provided with a spiral-shaped first feeding blade 301*a* capable of feeding the developer in a direction from the communicating portion 27 to the communicating portion 26 (FIG. 4), and feeds the developer in the first feeding direction (arrow F1 direction) along the circulation path in the stirring chamber 21*b*. The second spiral portion 302 is provided with a spiral-shaped second feeding blade 302*a* capable of feeding the developer in an opposite direction to the first feeding direction of the first spiral portion 301, and feeds the developer in a second feeding direction (arrow F2 direction) so as to push back the developer from an outside to an inside of the circulation path in the stirring chamber 21*b*. That is, the second spiral portion 302 is a returning screw. These first and second spiral portions 301 and 302 are provided so that a connecting portion H for connecting the first and second spiral portions 301 and 302 is disposed at a position opposing the communicating portion 26. The connecting portion H refers to a portion between the first feeding blade 301*a* of the first spiral portion 301 and the second feeding blade 302*a* of the second spiral portion 302. In this embodiment, the position where the communicating portion 26 is disposed overlaps with both of the first spiral portion with respect to a rotational axis direction of the stirring screw 22*b*. Thus, the developer can be efficiently delivered.

For example, the stirring screw 22*b* is 8 mm in shaft diameter, the first spiral portion 301 is 16 mm in fin diameter including the first feeding blade 301*a*, and the second spiral portion 302 is 16 mm in fin diameter including the second feeding blade 302*a*. That is, the first and second spiral portions 301 and 302 have the same diameter. Between the first feeding blade 301*a* of the first spiral portion 301 and the second feeding blade 302*a* of the second spiral portion 302, a range in which the first feeding blade 301*a* and the second feeding blade 302*b* are not provided is formed with a width of 2 mm for example. In this case, the first and second feeding blades 301*a* and 302*b* are not continuous. An inner wall height of the stirring chamber 21*b* is about 30 mm, and a gap of about 1 mm is ensured between an inner width of the stirring chamber 21*b* and each of outer peripheral portions of the first and second feeding blades 301*a* and 302*a*. The present invention is not limited thereto. For example, the first and second spiral portions 301 and 302 may also be not the same diameter, and the connecting portion H may also have a large width.

Upstream of the second spiral portion 302 with respect to the second feeding direction, a discharge opening 305 through which a part of the developer which is not returned by the second spiral portion 302 is caused to pass toward the third spiral portion 303 is provided with a spiral-shaped third feeding blade 303*c* capable of feeding the developer in an opposite direction to the second feeding direction of the second spiral portion 302 (i.e., in the same direction as the first feeding direction of the first spiral portion 301), and feeds the developer passed through the discharge opening 305 in an arrow F3 direction. Downstream of the third spiral portion 303 with respect to the feeding direction, a discharge opening 306 permits discharge of the developer fed by the third spiral portion 303 to an outside of the developing container 20.

Each of the spiral portions rotates in the same direction at the same speed. Then, the developer is fed toward the discharge opening 306 by the first spiral portion 301, but most of the fed developer is returned back by the second spiral portion 302 to pass through the communicating portion 26, thus being delivered to the developing chamber 21*a*. On the other hand, a part of the developer which is not returned back by the second spiral portion 302 gets over the second spiral portion to reach the discharge opening 305 and then pass through the discharge opening 305. The developer passed through the discharge opening 305 is fed to the discharge opening 306 by the third spiral portion 303. In this manner, the developer fed to the discharge opening 306 is discharged to the outside of the developing container 20 through the discharge opening 306.

When the developer is supplied as needed with the image formation, the amount of the developer in the developing container 20 gradually increases. This is because the toner is consumed during the image formation, but the carrier is not consumed but remains in the developing container 20. In the case where the developer amount in the developing container 20 increases, a developer surface of the developer in the developing chamber 21*a* and the stirring chamber 21*b* raises (increases in developer surface height). When the developer surface raises, of the developer fed by the first spiral portion 301, an amount of the developer returned back by the second spiral portion 302 decreases. For that reason, the developer in a large amount gets over, i.e., overflows the second spiral portion 302 to pass through the discharge opening 305, and then is fed by the third spiral portion 303 and is discharged through the discharge opening 306. Thus, in the case where the developer amount in the developing container 20 increases, the developer in a relatively large amount is discharged, and therefore the developer surface (height) of the developer in the stirring chamber 21*b* lowers. Then, of the developer fed by the first spiral portion 301, the amount of the developer returned back by the second spiral portion 302 increases. For that reason, most of the developer cannot get over the second spiral portion 302, so that the amount of the developer passing through the discharge opening 305 decreases. That is, the amount (discharge amount) of the developer to be discharged decreases. In this manner, replacement of the developer is automatically performed so as to maintain the developer amount in the developing container 20 at a constant level.

As described above, in the developing device 104, the developer is fed in opposite directions by the first spiral portion 301 and the second spiral portion 302 of the stirring screw 22*b*, so that the amount of the developer discharged to the outside of the developing container 20 is adjusted. However, in a conventional developing device, in the case a flowability of the developer is low, the developer was discharged in some instances although the developer amount was small to the extent that the developer had only the developer surface height at which the developer did not originally get over the second spiral portion 302. This will be described using FIGS. 4 and 5.

Figure 4:
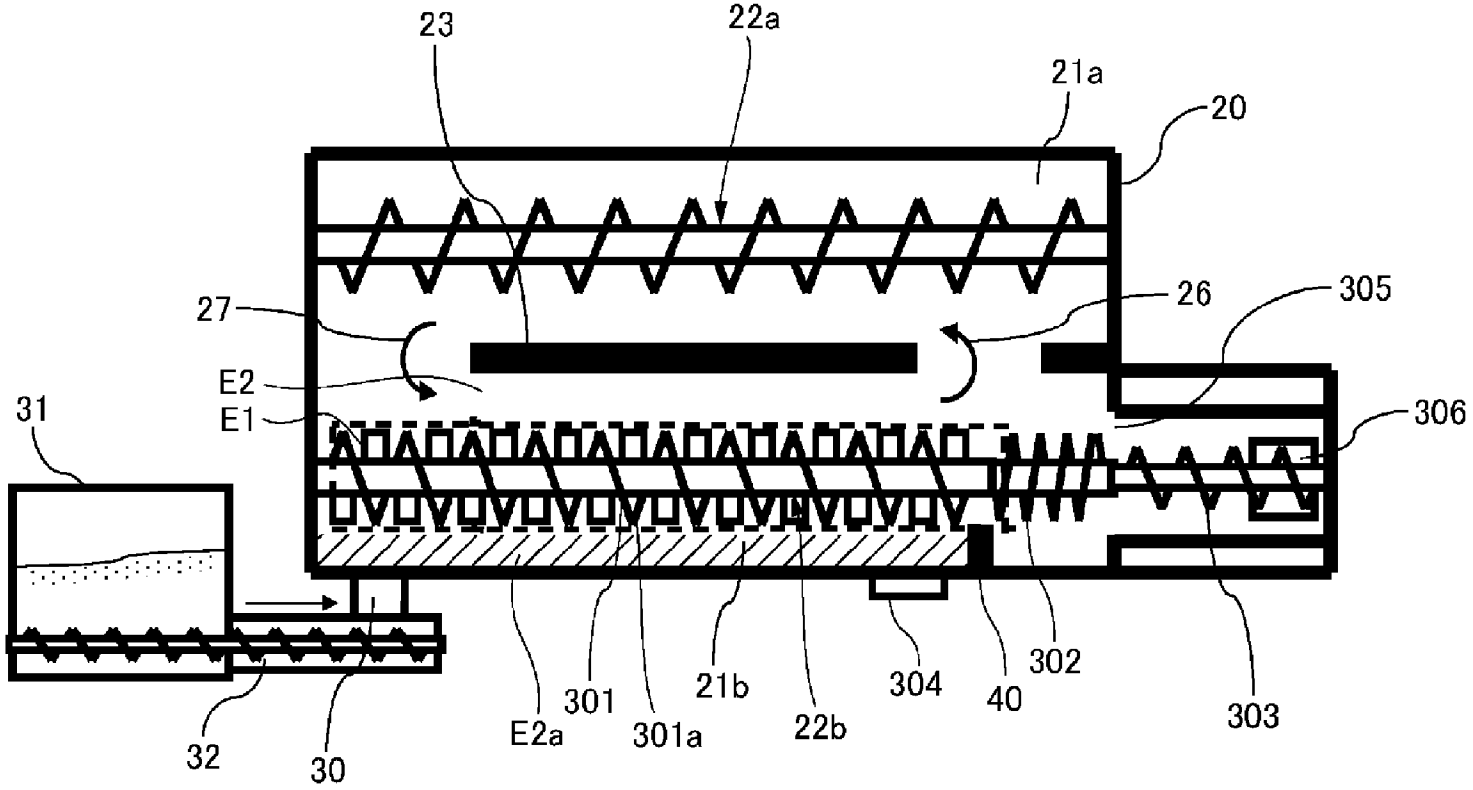
FIG. 4 is a sectional view of an upper surface structure of the developing device in cross-section parallel to the shaft with respect to an axial direction.

As shown in FIG. 4, in the stirring chamber 21*b*, the developer fed by the first spiral portion 301 is principally fed toward the second spiral portion 302 in a region E1 closer to the rotation shaft than a free end of the first feeding blade 301*a* of the first spiral portion 301 is. The developer is fed toward the second spiral portion 302 not only in the region E1 but also in regions E2 and E2*a* positioned outside the region E1, specifically in the regions E2 and E2*a* positioned between an outer peripheral portion (free end) of the first feeding blade 301*a* of the first spiral portion 301 and the inner wall (surface) of the stirring chamber 21*b*. However, in the regions E2 and E2*a*, the developer is fed while being pressed against the inner wall of the stirring chamber 21*b* with the rotation of the first spiral portion 301. For that reason, in the case where the flowability of the developer is low, the developer fed in the regions E2 and E2*a* is slower in feeding speed than the developer fed in the region E1. Particularly, in the region E2*a* remote from the developing chamber 21*a* in a side where the first feeding blade 301*a* of the first spiral portion raises to lift the developer, a pressing force of the developer against the inner wall increases, so that the developer feeding speed is slower than that in the region E1. When the flowability of the developer lowers, the developer stagnates in the region E2*a* and it is difficult to feed the developer.

Figure 5:
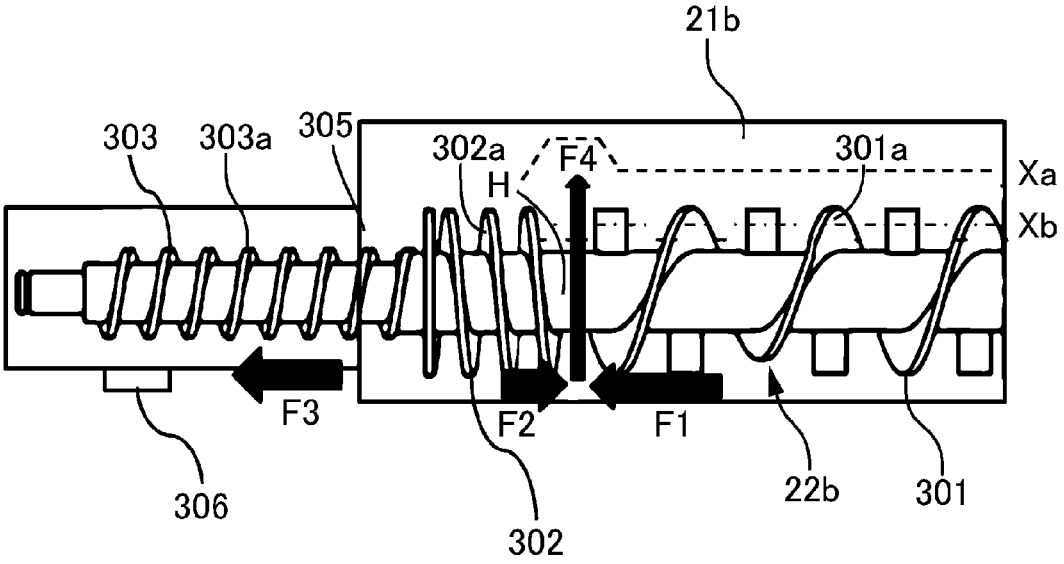
FIG. 5 is a partially enlarged view of a stirring screw.

In that case, as shown in FIG. 5, within a range of the connecting portion H where the developers fed by the first spiral portion 301 and the second spiral portion 302 abut against each other, the developer fed in the region E1 passes through the communicating portion 26 and flows into the developing chamber 21*a*. On the other hand, the developer fed in the region E2*a* does not readily flow toward the developing chamber 21*a*, i.e., the region E1 (FIG. 4) and also does not advance toward the second spiral portion 302, and therefore is accumulated upward (in an arrow F4 direction) along the inner wall of the stirring chamber 21*b* in front of the second spiral portion 302. In this manner, the developer is localized in the region E2*a*, and therefore the developer surface of the developer fed in the region E2*a* is higher than the developer surfaces of the developer fed in the regions E1 and E2, with the result that a mountain of the developer higher than the second spiral portion 302 is formed (broken line Xa). This mountain of developer is liable to collapse at a crest portion, and the collapsed developer gets over the second spiral portion 302 although an amount thereof is small, and is fed to and discharged through the discharge opening 306.

In this way, in the case of the developing device in which the developer discharge amount is adjusted by feeding the developer in opposite directions, irrespective of the amount of the developer in the developing container, the above-described mountain of developer can be formed. In the conventional developing device, for example, even during image formation in which a printing area per image sheet is small, the developer is continuously discharged little by little and thus the developer amount becomes excessively small, so that the developer was not able to be supplied to the developing sleeve 24 (FIG. 3) and thus generated the image defect.

<First Embodiment>

Therefore, the developing device 104 is provided with a regulating rib member 40 so as to project toward the stirring screw 22*b* in the neighborhood of the second spiral portion 302 in the stirring chamber 21*b*. In this embodiment, the regulating rib member 40 is disposed so as to block the region E2*a* on a side remote from the developing chamber 21*a* (FIG. 4), so that the developer fed in the region E2*a* is abutted against the regulating rib member 40 and then is returned into the region E1. The regulating rib member 40 as a projected portion is formed so that the stirring screw 22*b* is about 1 mm in length (thickness) with respect to a radial direction, about 1 mm in length (width) with respect to a rotational axis direction and about 30 mm in height, for example. In the following, the regulating rib member 40 will be described using (a) and (b) of FIG. 6.

[Position of Regulating Rib Member]

Figure 6:
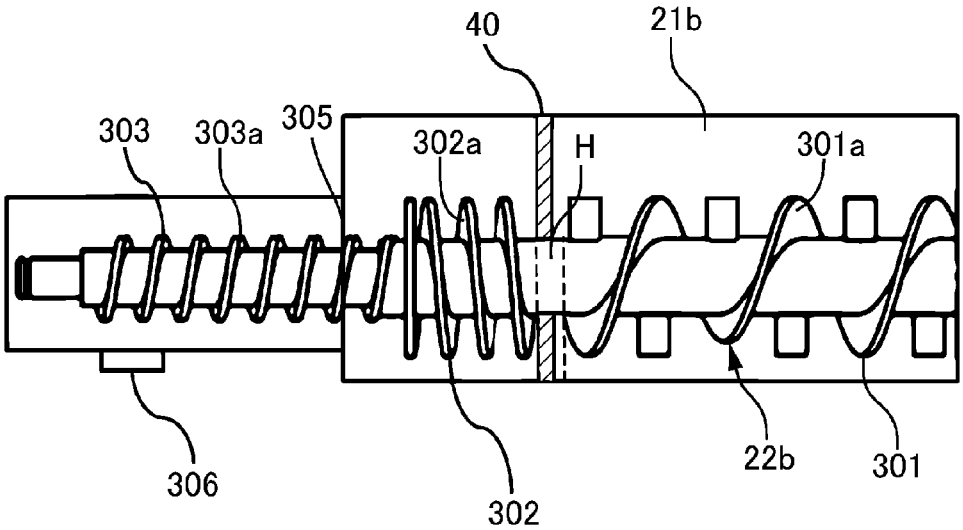
In FIG. 6, (a) and (b) are schematic views for illustrating a First Embodiment, in which (a) is a side view of a stirring chamber, and (b) is a sectional view of the stirring chamber in cross-section perpendicular to the shaft.
Figure 6:
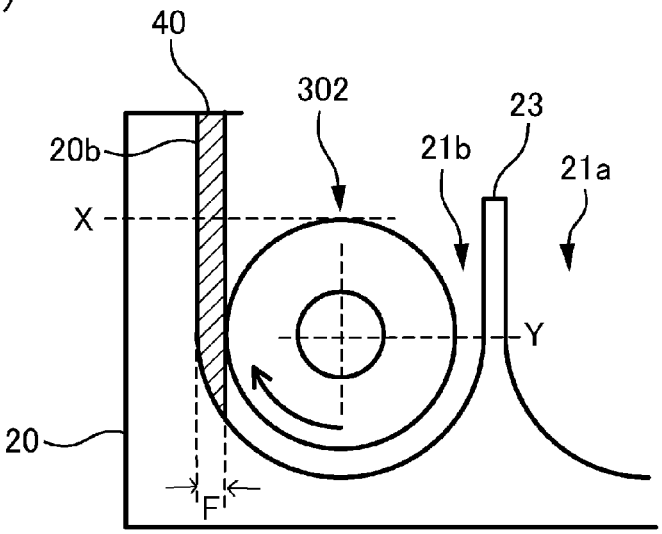

As shown in (a) of FIG. 6, the regulating rib member 40 is provided within a range opposing the connecting portion H connecting the first spiral portion 301 and the second spiral portion 302. That is, the regulating rib member 40 is projected from the portion opposing the connecting portion H with respect to the rotational axis direction of the stirring screw 22*b* so as to narrow a gap with the connecting portion H. In this embodiment, the connecting portion H refers to a range, from a downstream end of the first feeding blade 301*a* to a downstream end of the second feeding screw 302*a* with respect to the developer feeding direction, in which the first feeding blade 301*a* and the second feeding blade 302*a* are not provided.

The regulating rib member 40 is provided on the first spiral portion 301 side more than the downstream end of the second spiral portion 302 (specifically the second feeding blade 302*a*). For example, the regulating rib member 40 is provided at a position closer to the first spiral portion 301 by about 1 mm than the downstream end of the second spiral portion 302 with respect to the developer feeding direction is. In the case where the regulating rib member 40 is provided at a position largely spaced from the second spiral portion 302, the mountain of the developer is capable of being formed again from passing of the developer through the regulating rib member 40 in the region E2*a* until the developer reaches the second spiral portion 302 although the regulating rib member 40 is disposed. On the other hand, in the case where the regulating rib member 40 is provided at a position opposing the outer peripheral portion of the second feeding blade 302*a* of the second spiral portion 302, the developer fed in the region E2*a* is not readily returned to the region E1, and therefore the mountain of the developer is capable of being formed. In order to avoid these possibilities, the regulating rib member 40 is provided within the range of the connecting portion H and is disposed toward the second spiral portion 302. The regulating rib member 40 is formed so as to have a width in which the regulating rib member 40 does not overlap with the first spiral portion 301 (specifically the first feeding blade 301*a*) and the second spiral portion 302 (specifically the second feeding blade 302*a*).

As shown in (b) of FIG. 6 with reference to (a) of FIG. 6, the regulating rib member 40 is provided on an inner wall portion 20*b* of the stirring chamber 21*b* opposing a side where the first feeding blade 301*a* of the first spiral portion 301 raises and rotates. The inner wall portion 20*b* is an inner wall of the stirring chamber 21*b* opposing the partition wall 23 partitioning the developing chamber 21*a* and the stirring chamber 21*b*, via the stirring screw 22*b*. In this case, when the developing container 20 is viewed from the rotational axis direction of the stirring screw 22*b*, a side where the first feeding blade 301*a* (and the second feeding blade 302*b*) raise and rotate is a side opposite from the developing chamber 21*a* with respect to the rotation center of the stirring screw 22*b*.

[Size of Regulating Rib Member]

As shown in (b) of FIG. 6, the regulating rib member 40 is extended to a position lower than an upper end (position indicated by X in the figure) of the second spiral portion 302 at least at a lower end thereof along the inner wall portion 20*b* of the stirring chamber 21*b*, and a part of the regulating rib member 40 is buried in the developer. As a result, the developer fed in the region E2*a* is readily returned to the region E1 (FIG. 4). That is, when the developer fed in the region E2*a* abuts against the regulating rib member 40, the developer changes in movement direction from the rotational axis direction of the stirring screw 22*b* to the radial direction of the stirring screw 22*b*, i.e., toward the region E1. The developer changed in movement direction is taken in the flow of the developer moved by the first feeding blade 301*a* of the first spiral portion 301 while being stirred in the region E1. The developer in the region E2*a* is taken in the flow of the developer in the region E1, and therefore the height of the developer surface is lower than that in the conventional developing device. That is, the mountain of the developer is not readily formed. In order to more strongly promote the movement of the developer from the region E2*a* to the region E1, the lower end of the regulating rib member 40 may preferably be extended to a position equal to or lower than the rotation center of the second spiral portion 302, more preferably be extended to a bottom of the stirring chamber 21*b*.

On the other hand, the upper end of the regulating rib member 40 is extended to a position higher than the upper end (position indicated by X in (b) of FIG. 6) of the second spiral portion 302. As a result, movement of the developer which gets over the regulating rib member 40 and which moves from the region E2*a* toward the second spiral portion 302 is prevented. For that reason, the upper end of the regulating rib member 40 may preferably be extended to an uppermost portion of the stirring chamber 21*b*. That is, the regulating rib member 40 may preferably project to a height over an entire region of the inner wall portion 20*b* as a second wall portion.

As shown in (b) of FIG. 6, the regulating rib member 40 projects so that a gap (clearance) between the inner wall portion 20*b* and the connecting portion H becomes small. The thickness of the regulating rib member 40 may be formed so as to have a width at least equal to a width of the region E2*a*, but is actually formed so as to be substantially equal to the gap between the inner wall portion 20*b* and the outer peripheral portion of the second feeding blade 302*a* of the second spiral portion 302 (as indicated by F in the figure). The regulating rib member 40 has a higher developer feeding effect from the region E2*a* to the region E1 with an increasing thickness, but the increasing thickness also blocks the flow of the developer in the region E1, and therefore the regulating rib member 40 can largely impair the discharge of the developer in the case where the developer amount increases. For that reason, as described above, the thickness of the regulating rib member 40 may preferably be made substantially equal to the gap between the inner wall portion 20*b* and the outer peripheral portion of the second feeding blade 302*a* of the second spiral portion 302. The present invention is not limited thereto. The regulating rib member 40 may also be projected so as to overlap the second feeding blade 302*a* as seen in the rotational axis direction of the stirring screw 22*b*.

The regulating rib member 40 is formed of a resin material integrally with the developing container 20. In that case, the stirring screw 22*b* is inserted from a side opposite from the discharge opening 306 into the stirring chamber 21*b* along the rotational axis direction. When the thickness of the regulating rib member 40 is substantially equal to the gap between the inner wall portion 20*b* and the outer peripheral portion of the second feeding blade 302*a* of the second spiral portion 302, the regulating rib member 40 does not constitute an obstacle when the stirring screw 22*b* is assembled.

[Experiment Result]

Figure 7:
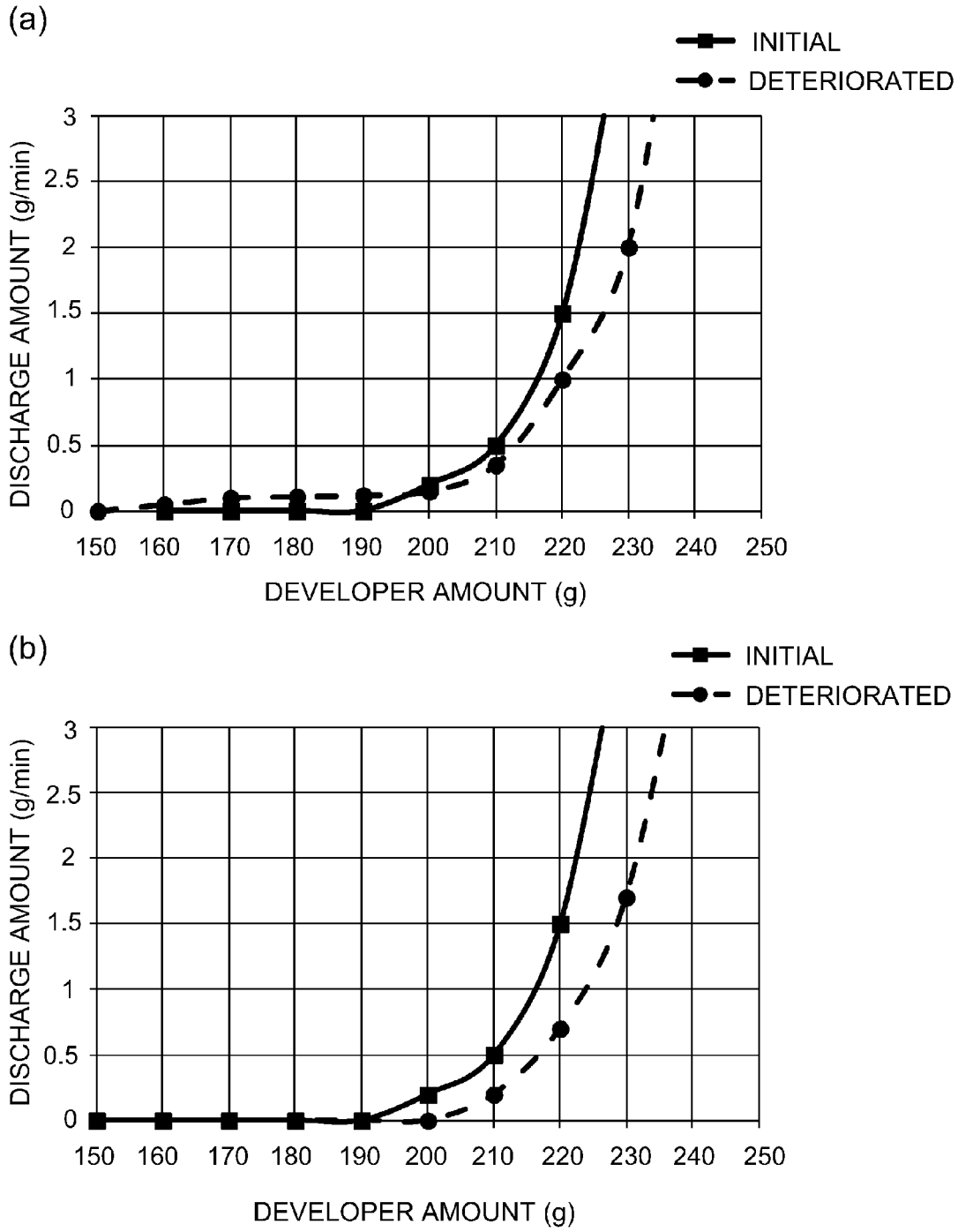
In FIG. 7, (a) and (b) are graphs each showing a developer discharging characteristic, in which (a) shows a conventional example in which no regulating rib member is provided, and (b) shows the case where a regulating rib member is provided.

The present inventors conducted an experimental study on a developer discharging characteristic. For comparison, an experiment was conducted also with respect to the conventional developing device in which the regulating rib member 40 was not provided. In this case, the experiment was conducted both in a state in which the toner was not deteriorated and the toner charge amount did not lower (initial developer) and in a state in which the toner was deteriorated and the toner charge amount lowered (deteriorated developer). An experimental result is shown in (a) of FIG. 7 and (b) of FIG. 7. In FIG. 7, (a) is a graph showing a developer discharging characteristic of the conventional developing device (conventional example), and (b) is a graph showing a developer discharging characteristic of the developing device in this embodiment. In (a) and (b) of FIG. 7, the experimental results of the initial developer was shown by a solid line, and the experimental result of the deteriorated developer was shown by a broken line. In these figures, the abscissa represents the developer amount in the developing container, and the ordinate represents a developer discharge amount per unit time. An amount of the developer accommodated in the developing container at an initial stage was 200 g. The developer amount in the developing container 20 fluctuates depending on a balance between the discharge amount and a supply amount of the developer.

As can be understood from the experimental result shown in (a) of FIG. 7, in the conventional developing device, irrespective of the initial developer and the deteriorated developer, when the developer is supplied and thus the developer amount increases (200 g or more), the discharge amount increases. On the other hand, as can be understood from the experimental result shown in (b) of FIG. 7, also in the developing device in this embodiment, similarly as in the case of the conventional developing device, when the developer amount increases, the discharge amount increases. This is because when the developer amount increases and becomes 200 g or more, the amount of the developer in the region E1 (FIG. 4) which gets over the second spiral portion 302 becomes large and thus the developer discharge amount per unit time increases. The reason why the discharge amount of the deteriorated developer is smaller than the initial developer at the same developer amount is that flowability of the developer lowers due to deterioration of the developer and thus an amount of the developer which gets over the second spiral portion 302 simply increases.

On the other hand, when the developer amount decreases (in the case where the developer amount is less than 200 g), in the conventional developing device, the discharge amount of the initial developer is 0, whereas the discharge amount of the deteriorated developer is not 0 until the developer amount in the developing container becomes 150 g. This means that the developer is continuously discharged from 200 g to 150 g in amount thereof. That is, it would be considered that compared with the deteriorated developer, the initial developer having a high flowability is good in feeding property also in the region E2*a* and thus is fed at the same feeding speed while moving between the region E2*a* and the region E1. In addition, in the case where the developer amount is smaller than 200 g, the height of the developer surface does not increase until the developer gets over the second spiral portion 302 and also the mountain of the developer is not formed (as indicated by a chain line Xb in FIG. 5), and therefore the developer discharge amount is 0.

On the other hand, in the case of the deteriorated developer lower in flowability than the initial developer, as described above, the developer fed in the region E2*a* is fed at a feeding speed slower than a feeding speed of the developer in the region E1. For that reason, the developer cannot move between the region E2*a* and the region E1, so that the amount of only the developer moving from the region E1 to the region E2*a* increases and thus the developer surface increases and the mountain of the developer is formed (as indicated by the broken line Xa in FIG. 5). As a result, although the developer amount in the developing container is small, the developer surface becomes high immediately in front of the second spiral portion 302, and the developer gets over the second spiral portion 302 during the collapse of the developer and then is discharged. Accordingly, the developer is continuously discharged until the developer amount becomes 150 g which is the developer amount in which the mountain of the developer is formed to have only a height at which the developer does not get over the second spiral portion 302.

On the other hand, in the developing device 104 in this embodiment described above, as can be understood from the experimental result shown in (b) of FIG. 7, even when the developer amount decreases (in the case where the developer amount is less than 200 g), both of the discharge amount of the initial developer and the discharge amount of the deteriorated developer were 0. This would be considered based on an effect of providing the regulating rib member 40 in the stirring chamber 21*b*. That is, the developer in the region E2*a* abuts against the regulating rib member 40 without being subjected to a feeding force in an opposite direction by the second spiral portion 302, and moves toward the region E1 and then is taken into the flow of the developer in the region E1. The mountain of the developer which has been generated in the region E2*a* in the conventional developing device due to the taking-in of the developer in the region E2*a* into the flow of the developer in the region E1 is not readily formed. For that reason, even the deteriorated developer is not discharged even when the developer amount decreases similarly as in the case of the initial developer.

As described above, the regulating rib member 40 is provided so as to decrease the gap (clearance) between the inner wall portion 20*b* and the connecting portion H. The regulating rib member 40 is formed so that the lower end thereof extends to a position lower than the upper end of the second spiral portion 302 (specifically to a position equal to or lower than the rotation center of the second spiral portion 302) and so that the upper end thereof extends to a position higher than the upper end of the second spiral portion 302. Further, the regulating rib member 40 is provided within the range of the connecting portion H where the developers fed in the opposite directions by the first spiral portion 301 and the second spiral portion 302 abut against each other. The developer in the region E2*a* abuts against the regulating rib member 40 without being subjected to the feeding force in the opposite direction by the second spiral portion 302. In that case, the developer abutted against the regulating rib member 40 in the region E2*a* moves toward the region E1 and then is taken in the flow of the developer in the region E1. The developer surface lower with the taking-in of the developer in the region E2*a* into the flow of the developer in the region E1, i.e., formation of the mountain of the developer in the region E2*a* becomes difficult. That is, the height of the developer surface of the developer in the region E2*a* can be made equal to the height in the region E1. As a result, a lowering in developer amount due to continuous discharge of the developer little by little can be suppressed, with the result that the developer amount can be maintained within a proper range.

Incidentally, of the developing devices, there is a developing device in which the connecting portion H connects the first spiral portion 301 and the second spiral portion 302 without forming a gap between the first feeding blade 301*a* and the second feeding blade 302*a*. That is, the first feeding blade 301*a* of the first spiral portion 301 and the second feeding blade 302*a* of the second spiral portion 302 are continuously formed. In that case, the regulating rib member 40 may preferably be provided toward the first feeding blade 301*a* side than a boundary (connecting position) between the first feeding blade 301*a* and the second feeding blade 302*a* since the formation of the mountain of the developer becomes difficult. There is a need that the regulating rib member 40 is formed in a thickness in which the regulating rib member 40 does not interfere with the opposing first and second feeding blades 301*a* and 302*a*. In this case, when the thickness of the regulating rib member 40 cannot be ensured to the extent that the developer fed in the region E2*a* can be returned to the region E1, the thickness of the regulating rib member 40 may be ensured by thinning a shaft of the first spiral portion 301 and/or the second spiral portion 302, for example.

As described above, also in the case of the developing device in which the connecting portion H connects the first and second spiral portions 301 and 302 without forming the gap between the first and second spiral portions 301 and 302. The formation of the mountain of the developer in the region E2*a* can be made difficult by providing the regulating rib member 40. However, in this case, the regulating rib member 40 is formed in such a thickness that the regulating rib member 40 does not interfere with the outer peripheral portion of the first belt 301 opposing the regulating rib member 40 and thus the clearance becomes small. Therefore, in the case where the developer amount increases, the feeding of the developer is impaired, so that the developer is not readily discharged. For that reason, in addition to formation of the gap between the first feeding blade 301*a* of the first spiral portion 301 and the second feeding blade 302*b* of the second spiral portion 302, the regulating rib member 40 may preferably be provided.

<Second Embodiment>

Therefore, in a Second Embodiment, a regulating rib member 41 is provided in the stirring screw 21b so as to extend to an upper end of the second spiral portion 302 at a lower end thereof. In this embodiment, the regulating rib member 41 is disposed so as to cover an upper portion of the region E2*a* on a side remote from the developing chamber 21*a*, so that the developer in the region E2*a* is suppressed from above by the regulating rib member 41 and then is returned into the flow of the developer in the region E1. The regulating rib member 41 as a projected portion is formed so that the stirring screw 22*b* is about 1 mm in length (thickness) with respect to a radial direction, about 5 mm in length (width) with respect to a rotational axis direction and about 13 mm in height, for example. In the following, the regulating rib member 41 will be described using (a) and (b) of FIG. 6.

[Position of Regulating Rib Member]

Figure 8:
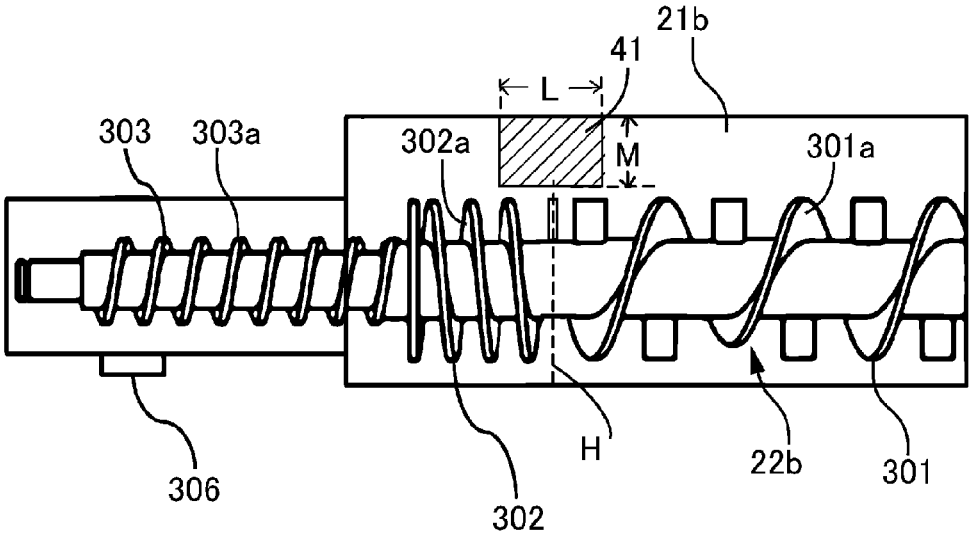
In FIG. 8, (a) and (b) are schematic views for illustrating a Second Embodiment, in which (a) is a side view of a stirring chamber, and (b) is a sectional view of the stirring chamber in cross-section perpendicular to a shaft.
Figure 8:
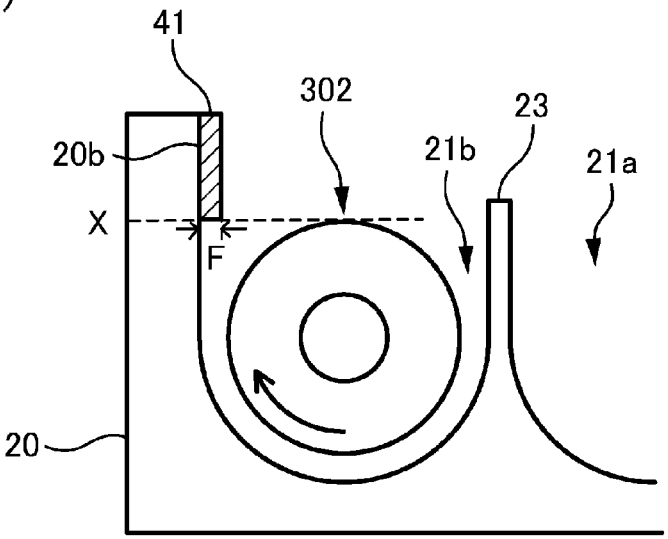

As shown in (a) of FIG. 8, the first spiral portion 301 and the second spiral portion 302 are connected with each other without forming a gap between the first feeding blade 301*a* and the second feeding blade 302*a*. That is, the first spiral portion 301 and the second spiral portion 302 are provided so that the lower end of the first feeding blade 301*a* with respect to the developer feeding direction and the lower end of the second feeding blade 302*a* with respect to the developer feeding direction are continuous to each other, so that compared with the First Embodiment, there is no range in which the first feeding blade 301*a* and the second feeding blade 302*a* are not provided. In the Second Embodiment, the connecting portion H refers to a connecting position between the first feeding blade 301*a* of the first spiral portion 301 and the second feeding blade 302*a* of the second spiral portion 302. The regulating rib member 41 is provided so as to project from a portion opposing a predetermined range including at least the connecting portion H toward the connecting portion H. In a preferred example, the regulating rib member 41 is provided at a position, including a position where the first feeding blade 301*a* and the second blade 302*a* are continuous to each other, opposing the outer peripheral portions of the first feeding blade 301*a* of the first spiral portion 301 and the second feeding blade 302 *a* of the second spiral portion 302. In order to avoid prevention of the feeding of the developer in the case where the developer amount increases, the regulating rib member 41 is formed in a width (L in (a) of FIG. 8) corresponding to one pitch to three pitches of the second feeding blade 302*a*, preferably one pitch (3 mm for example).

[Size of Regulating Rib Member]

As shown in (b) of FIG. 8, the regulating rib member 41 is extended to a position lower than an upper end (position indicated by X in the figure) of the second spiral portion 302 at least at a lower end thereof along the inner wall portion 20*b* of the stirring chamber 21*b*. On the other hand, an upper end of the regulating rib member 41 is extended to an upper most portion of the stirring chamber 21*b*. Further, the regulating rib member 41 is projected so as to decrease a clearance (gap) between the inner wall portion 20*b* and the connecting portion H. The regulating rib member 41 may be formed in a thickness (F in (b) of FIG. 8) at least equal to a width of the region E2*a*, but is actually formed in the thickness (F in the figure) substantially equal to a gap between the inner wall portion 20*b* and the outer peripheral portion of the second feeding blade 302*a* of the second spiral portion 302.

Further, the regulating rib member 41 is formed in the same thickness from the upper end to the lower end thereof along the inner wall portion 20*b*. This is because when the regulating rib member 41 is provided as in a shape of an upper wall, in the case where the developer amount increases, the feeding of the developer is impaired and thus the discharge of the developer becomes difficult. When the discharge of the developer becomes difficult, the developer amount in the developing container 20 increases and can cause overflow or the like of the developer. In order to avoid this phenomenon, in this embodiment, the regulating rib member 41 is provided so as to cover also the upper portion (region E1) of the first spiral portion 301, and is not provided over a full width of the stirring screw 22*b* with respect to the radial direction in cross-section.

The lower end of the regulating rib member 41 is extended to an upper end level of the second spiral portion 302, so that the developer fed in the region E2*a* is easily returned to the region E1 (FIG. 4). That is, the developer fed in the region E2*a* is, as described above, subjected to the feeding force in the opposite direction by the second spiral portion 302, so that the developer moves upward and is capable of forming the mountain thereof. However, in this embodiment, at the upper portion to which the developer moves, the regulating rib member 41 is provided, and therefore the developer is suppressed by a lower end surface of the regulating rib member 41 and thus cannot move to the upper portion. The developer which has no place to go by being suppressed by the regulating rib member 41 changes in movement direction to the radial direction of the stirring screw 22*b*, i.e., toward the region E1. The developer changed in movement direction is taken in the flow of the developer moved by the first feeding blade 301*a* of the first spiral portion 301 while being stirred in the region E1. In order to create the movement of the developer from the region E2*a* to the region E1, the lower end of the regulating rib member 41 is disposed at the above-described P.

As described above, the formation of the mountain of the developer is made difficult by suppressing the developer by the regulating rib member 41, but the width of the regulating rib member 41 is excessively small, the suppressed developer is sent toward the second spiral portion 302 as it is without moving toward the region E1. As a result, the amount of the developer to be discharged increases. In order to avoid the increase in developer amount, the regulating rib member 41 is formed in a width of one pitch to three pitches of the second feeding blade 302*a*. With a larger width, an effect of feeding the developer in the region E2*a* to the region E1 becomes higher, but when the width is made excessively broad, movement of the developer at the second spiral portion 302 close to the discharge opening 306 is made, so that the developer to be discharged increases. For that reason, as described above, the width of the regulating rib member 41 may desirably be formed in one pitch width of the second feeding blade 302*a*.

As described above, in this embodiment, the regulating rib member 41 is provided at the upper portion of the region to suppress the developer, in comparison with the First Embodiment. An effect of returning the developer, fed in the region E2*a*, to the flow of the developer in the region E1 is small. Therefore, the regulating rib member 41 is formed in the width of one pitch to three pitches of the second, so that the effect of feeding the developer in the region E2*a* to the region E1 is enhanced. As a result, similarly as the First Embodiment, the mountain of the developer is not readily formed in the region E2*a*, and therefore the lowering in developer amount due to continuous discharge of the developer little by little can be suppressed, with the result that the developer amount can be maintained in a proper range. Particularly, in the case where the first feeding blade 301*a* of the first spiral portion 301 and the second feeding blade 302*a* and the second spiral portion are continuously formed, a higher effect can be obtained.

<Other Embodiments>

In the above-described embodiments, the image forming apparatus 1 having the constitution in which the toner images are primary-transferred from the photosensitive drums 101Y to 101K onto the intermediary transfer belt 121 and then the composite color toner images are secondary-transferred collectively onto the recording material P was described, but the present invention is not limited thereto. For example, an image forming apparatus of a direct transfer type in which the toner images are directly transferred from the photosensitive drums 101Y to 101K onto the recording material P carried and fed by a transfer material feeding belt may also be used. The photosensitive drums 101Y to 101K are not limited to the drum-shaped photosensitive member, but may also be a belt-shaped photosensitive member. Further, the charging type, the transfer type, the cleaning type and the fixing type are also not limited to the above-described types.

In the above-described embodiments, the developing device of the horizontal stirring type in which the developing container 20 is partitioned horizontally into the developing chamber 21*a* and the stirring chamber 21*b*, but the present invention is not limited thereto. The present invention is also applicable to a developing device of a vertical stirring type in which the developing container 20 is partitioned vertically into the developing chamber 21*a* and the stirring chamber 21*b*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-008972 filed on Jan. 20, 2015, which is hereby incorporated by reference herein in its entirety.

What is claimed is:

1. A developing device comprising:

a developing container capable of accommodating a developer which contains toner and a carrier and including a first chamber and a second chamber;

a partition wall configured to partitioning said first chamber and said second chamber;

a first communication portion configured to permit communication of the developer from said first chamber to said second chamber;

a second communication portion configured to permit communication of the developer from said second chamber to said first chamber, the developer being communicatable between said first chamber and said second chamber through said first communication portion and said second communication portion;

a developer supplying portion configured to supply the developer;

a developer discharging portion provided in said second chamber and configured to discharge a part of the developer;

a first conveying screw, provided in said first chamber, for conveying the developer in said first chamber in a first conveying direction;

a second conveying screw, provided rotatably in said second chamber, for conveying the developer in said second chamber, wherein said second conveying screw comprises, (i) a shaft;

(ii) a first blade portion formed helically on an outer peripheral surface of said shaft and configured to convey the developer in said second chamber in a second conveying direction opposite to the first conveying direction; and (iii) a second blade portion formed helically on an outer peripheral surface of said shaft at a position downstream of said first blade portion and upstream of said developer discharging portion with respect to the second conveying direction and configured to convey the developer in said second chamber in the first conveying direction;

wherein said second conveying screw rotates in a direction from said partition wall toward a lower portion of said second chamber with respect to a vertical direction; and a projected portion which is provided on an inner wall portion of said second chamber on a side opposing said partition wall and projects toward an interior of said second chamber while opposing a region of said second chamber, wherein said projected portion is positioned between said first blade portion and said second blade portion with respect to a rotational axis direction of said shaft and at a location where no helical blade portion is formed, said projected portion is also positioned to extend above an upper end of said second blade portion with respect to a gravitational direction.

2. A developing device according to claim 1, wherein said projected portion extends below a rotation center of said shaft with respect to the gravitational direction.

3. A developing device according to claim 1, wherein said projected portion is provided over an entire vertical region of said inner wall portion.

4. A developing device according to claim 1, wherein said projected portion is positioned closer to said second blade portion than to said first blade portion.

5. A developing device according to claim 1, wherein a thickness of said projected portion projected from said inner wall portion toward the interior of said second chamber is substantially equal to a clearance between said inner wall portion and an outer peripheral surface of said second blade portion.

6. A developing device according to claim 1, wherein with respect to the rotational axis direction of said shaft, said projected portion opposes the region and a second region where said second blade portion is formed and is projected from said inner wall portion toward the interior of said second chamber so as to extend over the region and the second region.

* * * * *